US009309014B2

(12) United States Patent
Rea et al.

(10) Patent No.: US 9,309,014 B2
(45) Date of Patent: Apr. 12, 2016

(54) MACHINE WITH VERTICAL AXIS FOR MAKING FILTER BAGS WITH INFUSION PRODUCTS

(75) Inventors: Dario Rea, Monterenzio (IT); Sauro Rivola, Riolo Terme (IT)

(73) Assignee: IMA INDUSTRIES S.R.L., Ozzano Emilia (IT)

( * ) Notice: Subject to any disclaimer, the term of this patent is extended or adjusted under 35 U.S.C. 154(b) by 701 days.

(21) Appl. No.: 13/643,535

(22) PCT Filed: Oct. 11, 2010

(86) PCT No.: PCT/IB2010/054583

§ 371 (c)(1), (2), (4) Date: Oct. 25, 2012

(87) PCT Pub. No.: WO2011/135409

PCT Pub. Date: Nov. 3, 2011

(65) Prior Publication Data

US 2013/0045848 A1 Feb. 21, 2013

(30) Foreign Application Priority Data

Apr. 30, 2010 (IT) ..... BO2010A0272

(51) Int. Cl.
*B65B 9/20* (2012.01)
*B65B 29/02* (2006.01)

(52) U.S. Cl.
CPC ..... *B65B 9/2035* (2013.01); *B65B 9/20* (2013.01); *B65B 29/02* (2013.01)

(58) Field of Classification Search
CPC ..... B65B 9/06; B65B 9/08; B65B 9/20; B65B 9/073; B65B 9/2014; B65B 9/2021; B65B 9/2035
USPC ..... 493/186, 195, 197, 205, 267, 476; 53/56, 450, 523, 574
See application file for complete search history.

(56) References Cited

U.S. PATENT DOCUMENTS

| | | | | |
|---|---|---|---|---|
| 3,218,776 | A * | 11/1965 | Cloud | 53/453 |
| 3,680,446 | A | 8/1972 | James et al. | |
| 3,774,509 | A * | 11/1973 | Heinzer | 493/235 |
| 3,844,090 | A * | 10/1974 | Pepmeier | 53/551 |
| 4,084,390 | A | 4/1978 | Schmachtel et al. | |
| 4,091,595 | A * | 5/1978 | Pelster et al. | 53/417 |

(Continued)

FOREIGN PATENT DOCUMENTS

| | | |
|---|---|---|
| DE | 28 10 244 A1 | 9/1979 |
| EP | 0 469 288 A1 | 2/1992 |

(Continued)

*Primary Examiner* — Gloria R Weeks
(74) *Attorney, Agent, or Firm* — Pearne & Gordon LLP

(57) ABSTRACT

A machine for making filter bags (1) with infusion products comprises: a feed station (3) for a continuous web (S) of filter paper; a station (4) for forming and joining the continuous web (S) in a closed tubular shape which is fed along a vertical feed axis (Z); a station (5) for filling the product with a pusher element (9) able to move along the vertical feed axis (Z); a station (6) for joining an open lower end of the continuous tubular web (S) forming, alternately, the bottom end (F) and the top end (T) of individual filter bags (1); a handling and control unit for the bottom end (F) able to move in such a way that it is synchronized with the joining station (6) along the vertical feed axis (Z) for pulling the web of filter paper (S) and controlling the position of the bottom end (F) of the filter bag (1) being formed.

13 Claims, 11 Drawing Sheets

(56) References Cited

U.S. PATENT DOCUMENTS

| | | | | |
|---|---|---|---|---|
| 4,109,792 | A * | 8/1978 | Greenawalt et al. | 206/525 |
| 4,133,162 | A * | 1/1979 | Baumstingl | 53/450 |
| 4,262,473 | A * | 4/1981 | Brooke | 53/450 |
| 4,384,438 | A * | 5/1983 | Hilmersson | 53/51 |
| 5,125,213 | A | 6/1992 | Focke et al. | |
| 5,502,951 | A * | 4/1996 | Oliverio et al. | 53/455 |
| 5,533,322 | A * | 7/1996 | Bacon et al. | 53/451 |
| 5,540,035 | A * | 7/1996 | Plahm et al. | 53/451 |
| 6,119,438 | A * | 9/2000 | Bacon et al. | 53/451 |
| 6,182,421 | B1 * | 2/2001 | Sullivan | 53/438 |
| 6,295,790 | B1 * | 10/2001 | McGregor et al. | 53/374.3 |
| 6,427,422 | B2 * | 8/2002 | Nakagawa et al. | 53/437 |
| 6,658,825 | B1 * | 12/2003 | Bliek et al. | 53/522 |
| 6,758,737 | B2 * | 7/2004 | Svensson | 453/59 |
| 7,076,931 | B1 * | 7/2006 | Trani et al. | 53/452 |
| 7,188,458 | B2 * | 3/2007 | Rea et al. | 53/134.2 |
| 8,333,050 | B2 * | 12/2012 | Rea et al. | 53/134.2 |
| 8,409,065 | B2 * | 4/2013 | Kiyota et al. | 493/189 |
| 8,733,069 | B2 * | 5/2014 | Fischer | 53/448 |
| 8,959,879 | B2 * | 2/2015 | Iwasaki et al. | 53/551 |
| 2009/0263546 | A1 | 10/2009 | Rea et al. | |
| 2010/0176007 | A1 | 7/2010 | Rea et al. | |

FOREIGN PATENT DOCUMENTS

| | | | |
|---|---|---|---|
| WO | 99/47423 | A2 | 9/1999 |
| WO | 2008/015509 | A2 | 2/2008 |
| WO | 2008/152498 | A1 | 12/2008 |

* cited by examiner

MACHINE WITH VERTICAL AXIS FOR MAKING FILTER BAGS WITH INFUSION PRODUCTS

TECHNICAL FIELD

This invention relates to a machine for making filter bags with infusion products, such as tea, coffee, chamomile and the like.

BACKGROUND ART

At present machines for making filter bags are designed according to various architectures depending on the shape of the filter bag and/or the type of product it contains.

For making traditional type single- or double-chamber, single- or double-lobe filter bags (containing narrow or fine leaf products which can be compacted), machines are usually structured according to a substantially horizontal feed/production line, so that they guarantee high operating speeds and high productivity.

For filter bags which have different geometries, in particular single-chamber with greater three-dimensional dimensions, such as prior art pyramid-shaped filter bags (which may also contain wide or rounded leaf products), machines are used which are structured with a substantially vertical feed/production line, although allowing lower operating speeds and lower productivity.

In machines with a horizontal production line a continuous web of filter paper is fed horizontally along a predetermined path in which the web encounters a series of operating stations designed to allow the production of a continuous tube of filter paper. Said stations include a product filler positioned perpendicularly to the web being fed and designed to deposit a predetermined charge of product with predetermined spacing between each charge on the web. Then there is a series of stations designed to fold the continuous tube, to seal edges of the tube and if necessary to apply a string, tag and outer envelope. Single-chamber, single-lobe filter bags obtained with machines which have a horizontal production line are usually relatively flat, in other words they have reduced three-dimensional dimensions.

With machines using a vertical feed-production axis, on the other hand, it is possible to make pyramid-shaped single-chamber filter bags which have considerable three-dimensional dimensions. Such machines comprise a feed channel extending vertically on which a continuous web of filter paper is wrapped to form a tube, into which the product is made to fall by gravity using screw fillers or revolving fillers. Once filled with product, the tube is intercepted, during tube feed, by a forming and closing station for forming the filter bag into the desired shape and for closing the open edges. Such machines with a vertical feed/production axis for pyramid-shaped single-chamber filter bags have lower operating speeds than machines which have a horizontal feed/production axis for single-chamber, single-lobe filter bags. Usually, machines with a vertical feed/production axis are combined with additional and independent machines (connected to each other by means of suitable conveyor belts) for applying any accessories, such as string, a tag, and if necessary an outer envelope, to the filter bags.

As is briefly illustrated, machines with a horizontal feed/production axis and machines with a vertical feed/production axis have intrinsic features, linked to the operating speeds and the type of filter bag to be made.

At present, there is commercial demand for packaging wide-leaf infusion products in single-chamber, single-lobe filter bags with significant three-dimensional dimensions, for example of the type illustrated in patent applications WO 2008/015509 and WO 2008/152498. Such bags are difficult to make on machines with horizontal feed. This is because in such machines the filter paper has reached extremely high speeds and accelerations and placing the charges of product on the filter paper web is a problem.

The speed and accelerations which would be applied to the charges of wide-leaf product (often having rounded edges) uncompacted and deposited on the filter paper web, would result in product movements on the web, with respective breaking up of the charge. That would cause a low end quality of the filter bag, for example different quantities of charge in each filter bag made, or product trapped in the seals on the edges.

Therefore, obviously, in order to be able to use this type of product on machines with horizontal feed the operating speed would have to be reduced to the detriment of productivity in the unit of time, causing a reduction in the real capacity of the machine, but without even providing the certainty of a good result on the finished product.

Moreover, as already indicated, prior art machines with a horizontal production line do not allow single-chamber, single-lobe bags with significant three-dimensional dimensions to be made.

Machines with feed/production along the vertical axis have the problem already indicated, of operating speed and productivity which are lower than those of horizontal type machines. This is mainly due to the filling system and the consequent structuring of the machine in its entirety.

Filling is performed using gravity along the vertical axis and using, for example, screw feeder or revolver systems. Therefore, filling requires relatively long times correlated with the speed of the systems, the drop time for the product to be filled and the distance between the filler and the subsequent stations for handling the filter bags.

Moreover, machines of the type just described are extremely bulky.

In addition, as already indicated, this type of structure means that these machines must be connected to a second machine which allows the application of additional elements to the filter bag with respective release/conveyor/pickup systems present between the two machines.

DISCLOSURE OF THE INVENTION

Therefore, this invention has for an aim to overcome the above-mentioned disadvantages by providing a machine and a method for making filter bags which have considerable three-dimensional dimensions for infusion products, such as wide leaf tea.

Another aim of this invention is to produce a machine for making filter bags which uses vertical axis feed, having high operating speed and productivity, reduced dimensions and integrated auxiliary stations.

These and other aims are achieved by a machine according to claim 1 and a method according to claim 10.

A machine for making filter bags with infusion products according to this invention comprises a station for the guided forming and joining of a continuous web of filter material into a closed tubular shape which is fed along a vertical feed axis, and a station for joining an open lower end of the tubular strip in such a way as to form, alternately, the bottom end and the top end of individual filter bags.

The machine according to the invention also comprises a filling station located above the forming and joining station. The filling station performs controlled filling, that is to say, forced filling of the product.

The filling station comprises a pusher element, able to move in both directions along the vertical feed axis, which pushes in acceleration a charge of product onto the bottom end of the filter bag being formed. The pusher element, which passes through a tubular connecting core between the filling station and the forming and joining station for the continuous web of filter paper, guarantees a reduced filling time and precise and secure positioning of the charge of product on the bottom end of the filter bag being formed.

The product filling system is particularly compact and has reduced dimensions, and it allows high productivity.

A filling station can be used which has a pusher element able to move thanks to the presence in the machine of a compact and rational handling and control unit, which acts on the continuous tubular web of filter paper and on the filter bag being formed during successive forming, joining, filling and separating steps, to obtain continuity in the handling and control of the continuous tubular web of filter paper and the filter bag being formed.

The handling and control unit comprises first support and control means for the closed bottom end of the filter bag being formed, these support and control means being able to move along the vertical feed axis in such a way that they are synchronised with the joining station, between a raised position for supporting the closed bottom end of the filter bag being formed, and a lowered release position.

The first support and control means pull the tubular web of filter paper downwards as the charge is deposited and allow precise control of the position of the bottom end of the filter bag being formed, with controlled release of the filter bag once it has been received by second support and control means, and also once the top end of the filter bag has been formed, thus guaranteeing correct filling, precise forming and closing of the filter bag, and bag depositing in a subsequent station designed to separate the filter bag from the continuous web of filter paper.

Advantageously, operation of the first and second support and control means is synchronised with third support and control means for pulling a previous filter bag and, after a step of separating it from the web of filter paper using cutting means, depositing it in a station for application of additional elements.

Advantageously, the station for application of additional elements on the filter bag formed, such as string, a tag and an outer envelope, is integrated in the machine according to the invention and is synchronised with the forming and joining station, the filling station, the handling and control unit and further stations for forming the filter bag, thus reducing the machine overall dimensions.

In an alternative embodiment, the string and/or tag may be applied to the continuous web of filter material before the forming and joining station. In that alternative embodiment, the station for application of additional elements will only apply the outer envelope, if required, or it may be omitted.

The first, second and third support and control means have reduced dimensions and allow the forming and joining station and the filling station to be very close to each other, so that the pusher element can perform a reduced stroke for filling the product, consequently reducing the times necessary for filling the product, which is advantageous in terms of machine productivity. In a preferred embodiment, the support and control means are grippers.

This combination of units/stations allows the forming operating zone to be compacted, leaving the possibility of positioning, below this zone, a space for the insertion of further stations for handling the bag and for the application of additional elements in reduced spaces and with the position of the filter bag always under control.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
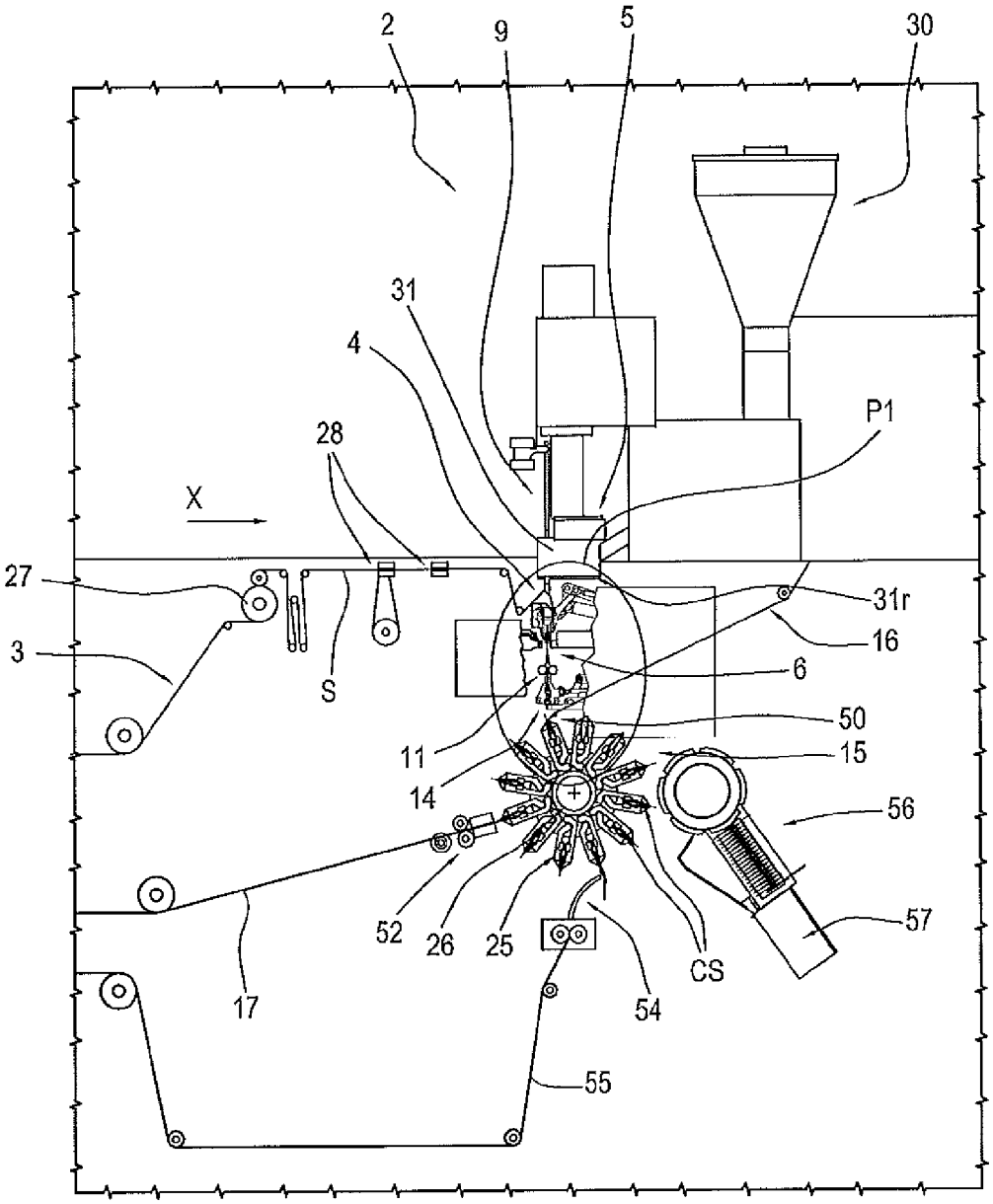
FIG. 1 is a schematic front view, with some parts cut away to better illustrate others, of a machine for making filter bags with infusion products according to this invention.

With reference to the accompanying drawings, and in particular FIGS. 1 to 8, a machine according to the invention, labelled 2 in its entirety, is used for making filter bags 1 with infusion products (such as tea, coffee, chamomile and the like).

In the case illustrated by way of example only, the filter bags 1 are of the single-chamber and single-lobe type with lateral folds and seals at the top and bottom ends (described below), for example of the type illustrated in patent applications WO 2008/015509 and WO 2008/152498.

The machine 2 comprises:

- a feed station 3 for feeding a flat continuous web S of filter material for forming the filter bags 1;
- a station 4 for the guided forming and joining of the continuous web S into a tubular shape which is fed along a vertical feed axis Z;
- a filling station 5 for filling the infusion product, the filling station being positioned above the forming and joining station 4;

a station 6 for joining an open lower end of the tubular web S alternately forming the bottom end F and the top end T of individual filter bags 1.

The filter material may advantageously be selected from amongst filter paper, heat-sealable filter paper, non-woven plastic materials, and other known materials for infusion products. For simplicity, the text below refers to filter paper.

In combination with the previous stations (see also FIGS. 2 to 11) there is also a tubular core 7 positioned along the vertical feed axis Z, constituting an extension of the filling station 5.

The core 7 is inserted in a cavity 8 made in the forming and joining station 4, in such a way that, in conjunction with the forming and joining station 4, it forms a shaping zone which forces the continuous web S around the core 7 at least until it is close to the joining station 6, which is positioned downstream of and below the forming and joining station 4, along the vertical feed axis Z. In practice, the continuous web S of filter paper is forced to pass inside the shaping zone, thus being folded into a tubular shape.

The forming and joining station 4, the core 7 and a handling and control unit described in detail below allow the correct tensioning and control of the continuous web S in the tubular shape along the vertical feed axis Z.

For example, the continuous web S of filter paper is fed in steps or intermittently, just as the stations present along the vertical feed axis Z are moved in steps or intermittently.

The filling station 5 (schematically illustrated in FIGS. 2 to 5) comprises a pusher element 9, able to move in both directions (see arrows F9) along the vertical feed axis Z inside the tubular core 7, and designed to act in acceleration on a charge D of product, for depositing the charge in a controlled fashion on the already formed bottom end F of the filter bag 1 being formed. Therefore, the pusher element 9 allows the charge D to be forced to fall onto the bottom end F of the filter bag 1, achieving a faster overall production speed thanks to the reduction in the correlated filling time.

The handling and control unit comprises first support and control means 10 for pulling and supporting the closed bottom end F formed on the tubular web S and for controlling the position of the closed bottom end F along the vertical feed axis Z.

The first support and control means 10 can move in such a way that they are synchronised with the pusher element 9 and with the joining station 6 along the vertical feed axis Z between:

a raised position, close to the forming and joining station 4, for supporting the bottom end F (see FIGS. 3, 4, 7, 9 and 11), and a lowered position, away from the joining station 6, for releasing the bottom end F of the filter bag 1 being formed after the top end T of the filter bag 1 being formed has been formed, as well as the bottom end of the next filter bag 1 (see FIGS. 2, 5, 6 and 8 and arrows F10).

As FIGS. 3, 4, 7, 9 and 11 show, the first support and control means 10 in the raised position are at the same height as the joining station 6 and take its place during the filling step. In other words, once the bottom of the filter bag 1 being formed has been formed, the first support and control means 10 clamp the bottom end F of the filter bag 1 being formed and then pull it to a lower height with a straight downward movement along the vertical feed axis Z.

Filling is performed using the pusher element 9 during the straight downward movement.

Once the lower height has been reached in the lowered position, the first support and control means 10 stop, return upwards by an amount such that the joining station 6 is supplied with enough filter paper to form the top end T of the filter bag being formed and the bottom end F of the next filter bag, then they stop again. Once the top end T and the bottom end F have been formed, second support and control means 12 begin operating to clamp in position the bottom end F of the filter bag 1 being formed. As soon as the second support and control means 12 have received the bottom end F of the filter bag 1 being formed, the first support and control means 10 release the bottom end F of the filter bag 1 being formed then return to the raised position and receive the bottom end F of the next filter bag 1, which will become the next filter bag 1 being formed.

The handling and control unit, in particular the first and second support and control means 10 and 12, acts in such a way that it is synchronised with the joining station 6.

Using the handling and control unit it is possible to achieve constant control of the position of the filter bag 1 being formed even at high production speeds, with consequent precision in the size and final quality of the bag.

The first support and control means 10 release the bottom end F of the filter bag 1 already formed (still connected to the next filter bag being formed) at a separating station 11 designed to separate the filter bag 1 already formed from the next filter bag 1 being formed where it is received by third support and control means 14.

As shown in FIGS. 2 to 9, the separating station 11 is located, along the vertical axis Z, downstream of the first support and control means 10 and of the second support and control means 12.

Looking in more detail at the stations just described, the station 3 for feeding the continuous web S (see FIG. 1) comprises at least one reel holder on which a reel of filter paper (not illustrated) is mounted, a set of rollers, at least one 27 of which is motor-driven, and pulling means 28 for feeding the continuous web S of filter paper with a stepping motion to the forming and joining station 4 along a horizontal axis X. The pulling means 28 are operated in such a way that they are synchronised with the handling and control unit, in particular the support and control means 10, for holding the continuous web S suitably taut.

The forming and joining station 4 (see also FIGS. 8, 10 and 11) comprises a set of shaped walls (forming what is known to experts in the field as a "folding collar") for folding the web S, in order to divert the web S from the horizontal axis X to the vertical axis Z. The folding collar forms the above-mentioned cavity 8 extending vertically and having a shaped cross-section, for example quadrangular, which engages with the tubular core 7, projecting up towards the filling station 5 and down beyond the forming and joining station 4.

On the opposite side of the horizontal feed axis X to that occupied by the forming and joining station 4, the collar comprises a pair of wings 20 and 21 (see FIG. 10), arranged in offset vertical planes, for superposing longitudinal free edges S1, S2 of the web S of filter paper.

The free edges S1 and S2 are superposed along a direction parallel with the vertical feed axis Z, thus forming a continuous tube of filter paper.

The forming and joining station 4 also comprises means 22 for joining the superposed free edges S1 and S2. The joining means 22 are positioned transversally to the vertical feed axis Z, and are opposite the tubular core 7, which in this case also acts as an opposing surface. The joining means 22 may comprise a hot sealer 29 (of the type schematically illustrated), or one or more sonotrodes for ultrasound sealing, or other known systems, for example depending on the filter material.

The filling station 5 comprises a feed hopper 30 for feeding product into a revolving drum 31 comprising a set of outer holders 23 forming individual charges D of product. The drum 31 rotates with a stepping motion about its vertical axis 31*z*, in such a way that with each revolution it brings an individual holder 23 into the filling zone at an axis Z' coaxial with the vertical feed axis Z. The drum 31 is equipped with a skimming wall 31*r* which is only open at the axis Z', in such a way that the charge D of product can move down in the tubular core 7 each time the corresponding holder 23 is in that position.

The pusher element 9 also moves along the axis Z'. The pusher element passes through the relevant holder 23, accelerating the depositing of the charge D on the bottom end F of the filter bag 1 being formed.

The pusher element 9 may comprise a solid rod whose cross-section is substantially shaped to match that of the tubular core 7 and can slide in both directions along the vertical feed axis Z thanks to suitable movement means 32 schematically illustrated in FIG. 1. The movement of the rod 9 allows it to pass through the holder 23 and the entire extension of the core 7 until it arrives close to the bottom end F of the filter bag 1. With a return stroke, the rod 9 comes out of the top of the drum 31, allowing the drum to rotate and bring the next holder 23 to the filling zone.

As FIGS. 1 to 11 show, the joining station 6 comprises a pair of sealing heads 6*a*, 6*b*, which can move perpendicularly to the vertical feed axis Z (see arrows F6 in FIG. 6) thanks to movement means of the known type (not illustrated) which allow two different positions:

- a joining position, with the heads 6*a* and 6*b* in contact on both sides of the continuous tube of filter paper (see FIGS. 2 and 8 and a partial view in FIG. 6) for forming the top end T of a filter bag 1 being formed and, simultaneously, the bottom end F of the next filter bag 1 which is higher up, and
- a non-operating position, away from the continuous tube, allowing the first support and control means 10 to be positioned at the bottom end F just formed.

The heads 6*a* and 6*b* remain in the non-operating position for long enough to allow the first support and control means 10 to receive the bottom end F and to pull it downwards by a predetermined step along the vertical feed axis Z, leaving space in an operating zone for the next sealing operation. Obviously, the heads 6*a* and 6*b* are of a size such that they form a joining zone which comprises both the bottom end F of the filter bag 1 with the respective final edge L central relative to the bottom end F, and the top end T of the previous filter bag 1 formed by a transversal band ST having predetermined length.

The first support and control means 10 comprise a pair of half-cradles 32 and 33 formed by shaped ends of two vertically extending levers 34 and 35. The levers 34 and 35 are hinged to a movement head 36, located behind the vertical feed axis Z, and with which a first movement of the half-cradles 32 and 33 away from and towards each other is obtained (see arrows F10 in FIG. 7) for releasing and, respectively, receiving the bottom end F of the filter bag 1.

Levers 37 of a known cam mechanism (not illustrated) are designed to move the head 36 (and therefore the levers 34 and 35 and the half-cradles 32 and 33) in a downstroke step and in an upstroke step along the vertical feed axis Z, synchronised with the movements of the sealing heads 6*a* and 6*b*.

Figure 7:
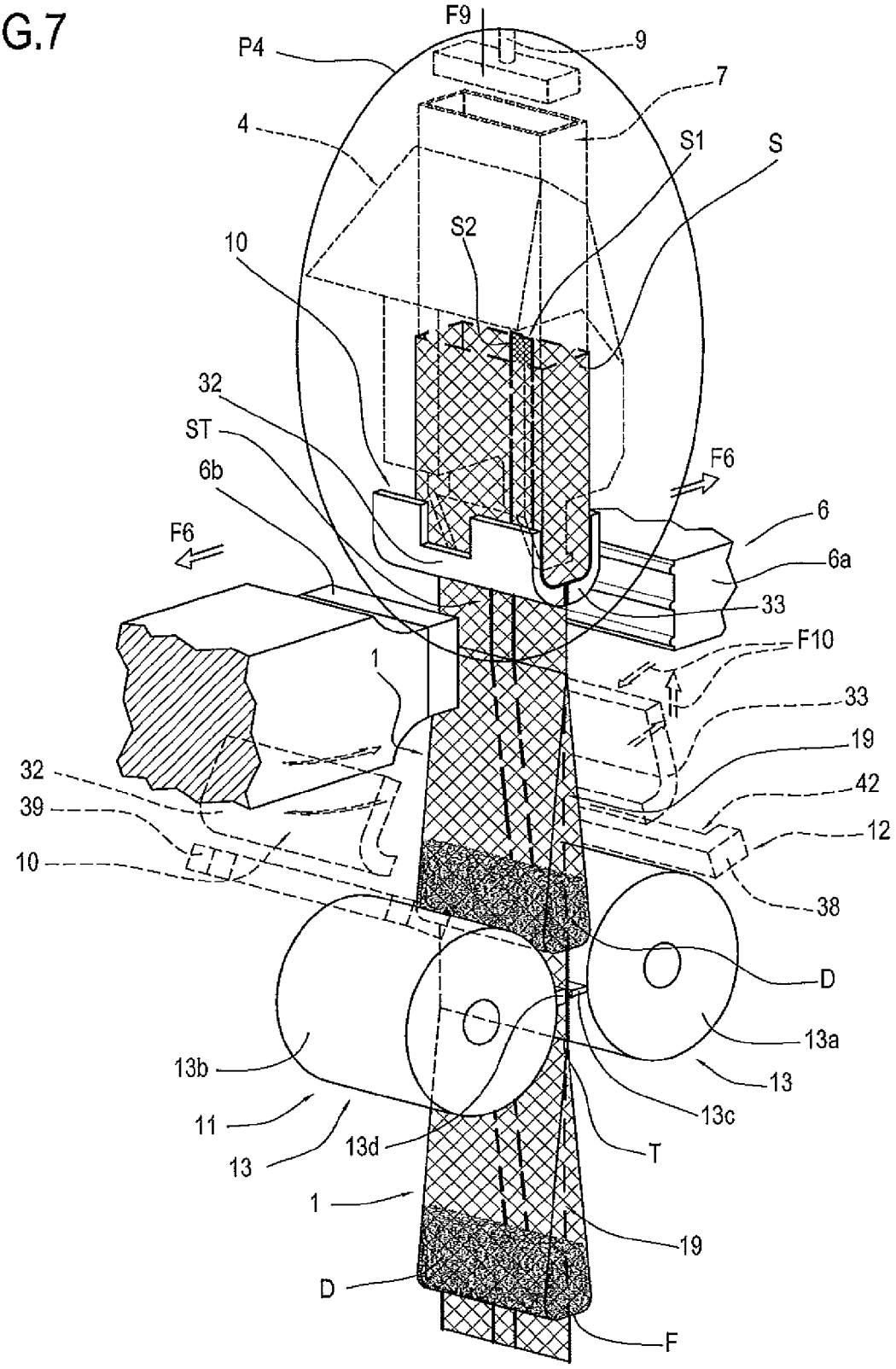
FIG. 7 is a schematic perspective view of the forming, filling, closing and separating zone of FIGS. 2 to 5, in simultaneous steps of separating a previous filter bag, and moving a filter bag being formed and the next filter bag.
Figure 8:
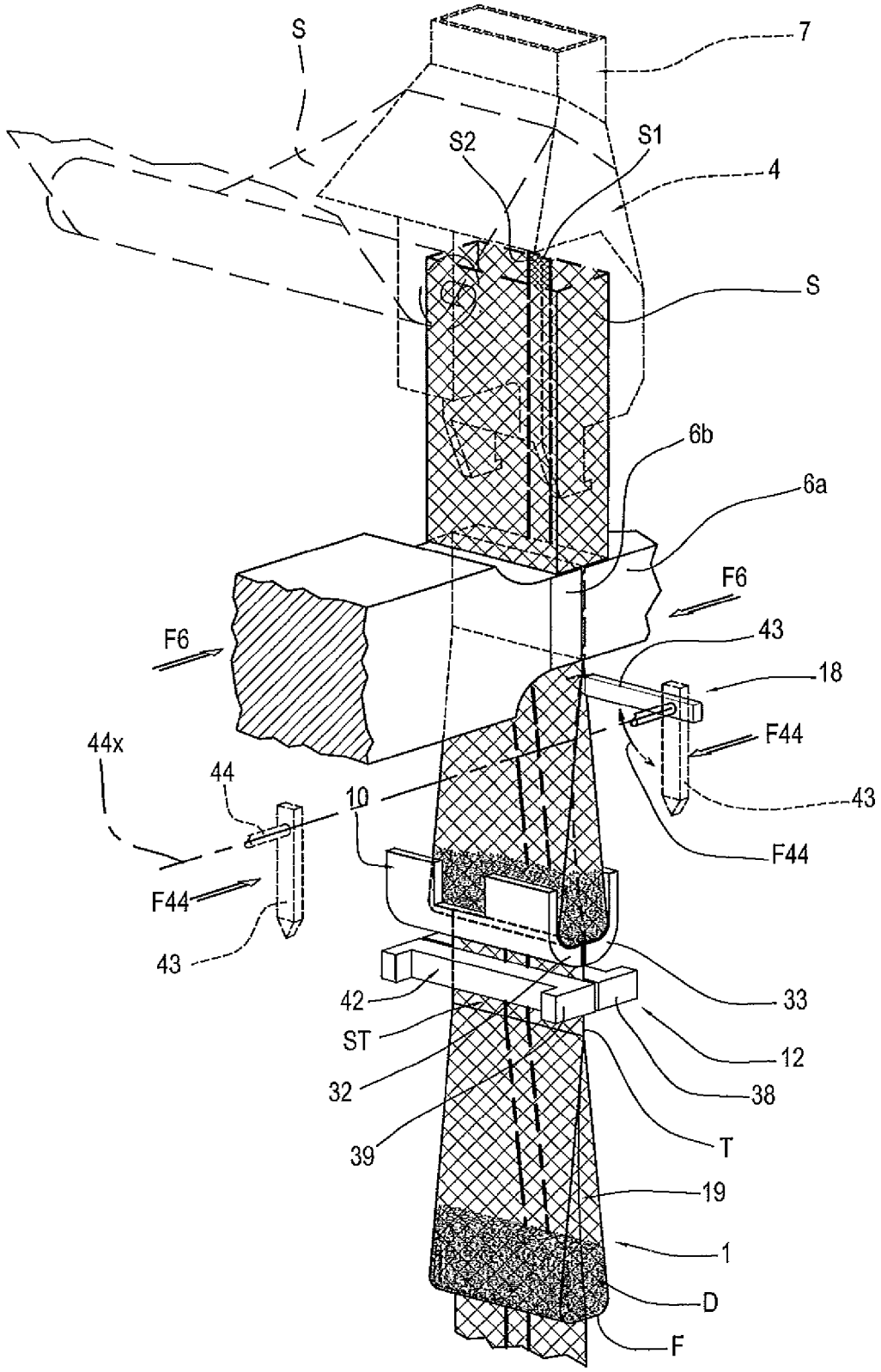
FIG. 8 is a schematic perspective view of the forming, filling and closing zone of FIGS. 2 to 5 in a step of closing the top end and bottom end respectively of a filter bag being formed and of the next filter bag.
Figure 9:
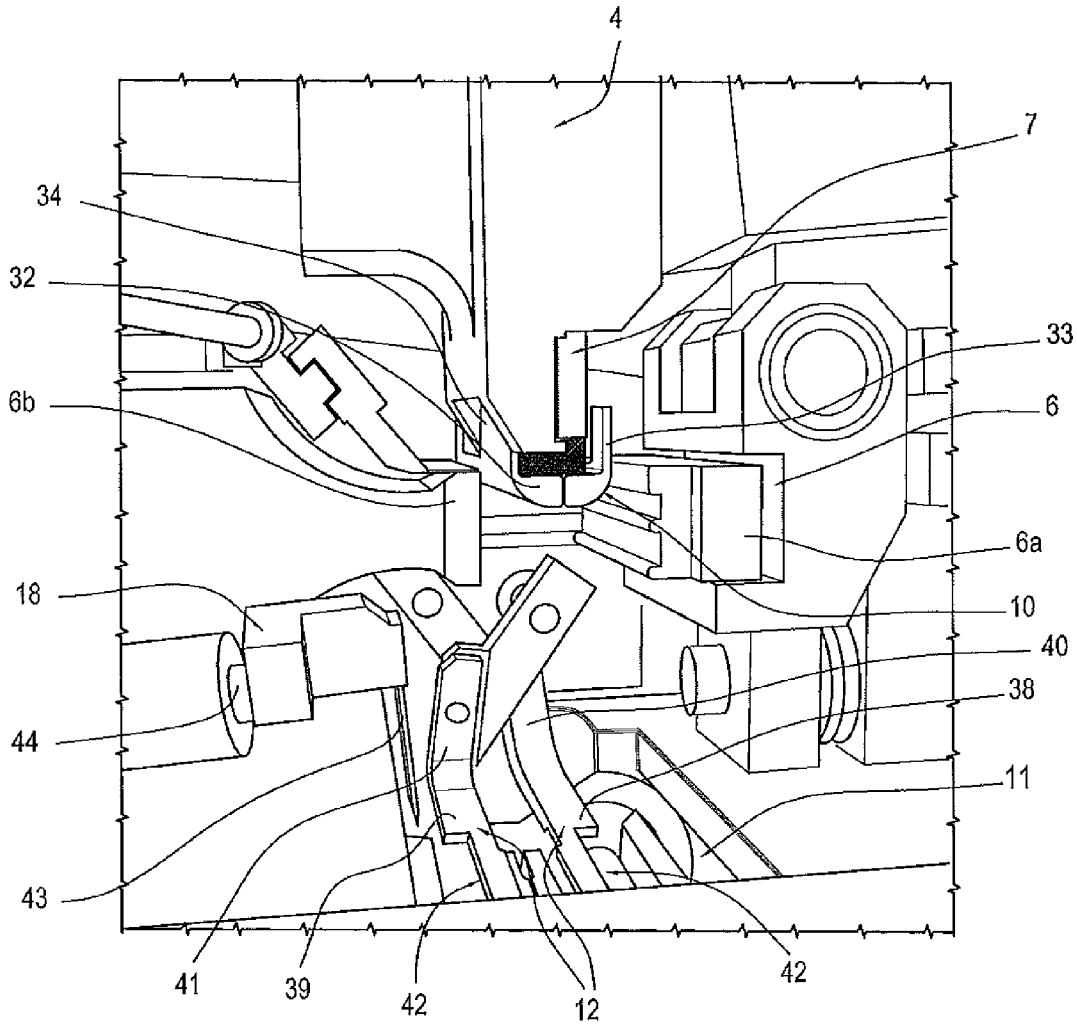
FIG. 9 is a simplified perspective view of a detail P3 referring to FIG. 4, with some parts cut away for clarity.
Figure 10:
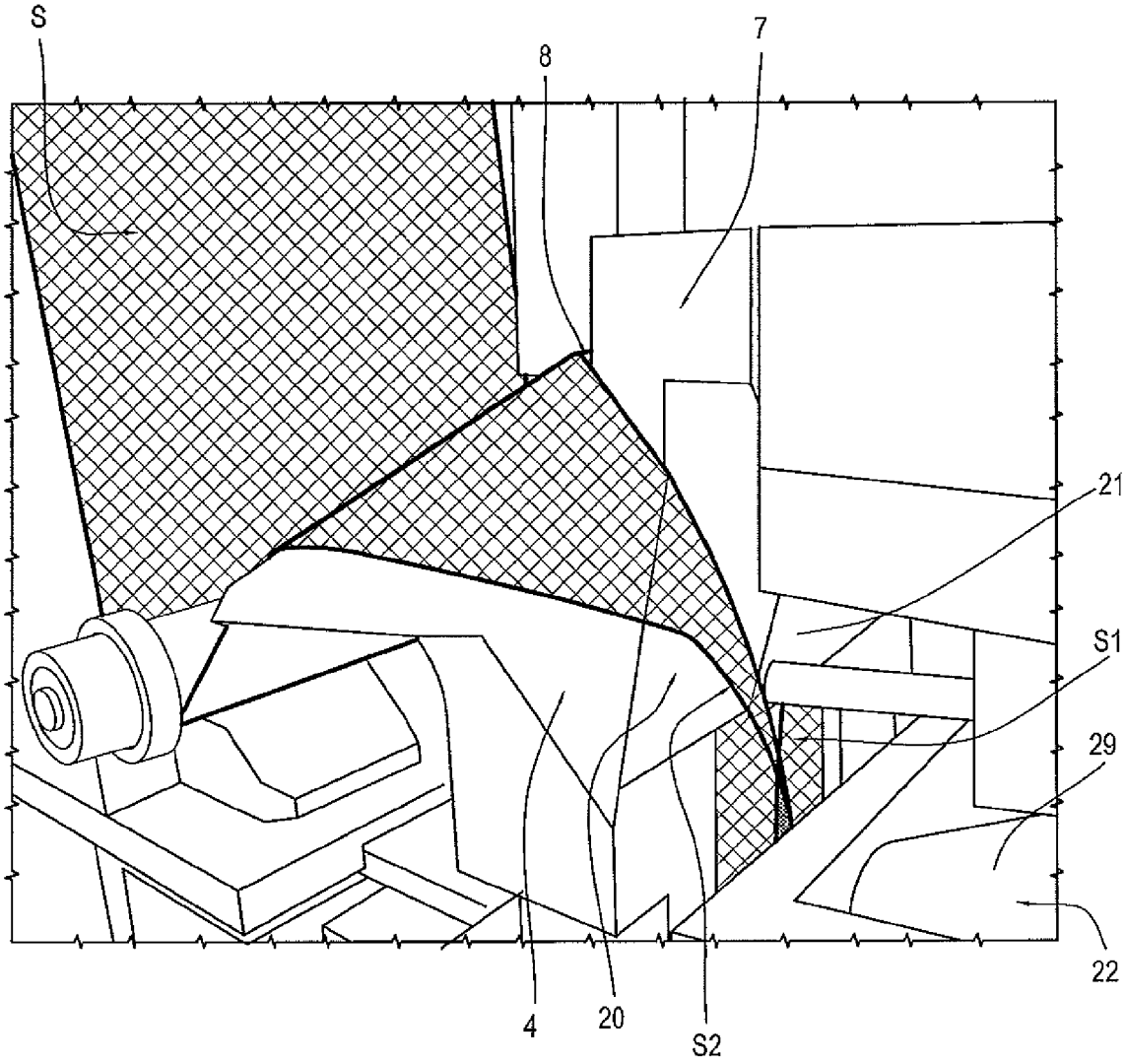
FIG. 10 is a perspective view of a part of a filter paper web forming and joining station which is part of the machine of the previous Figures.
Figure 11:
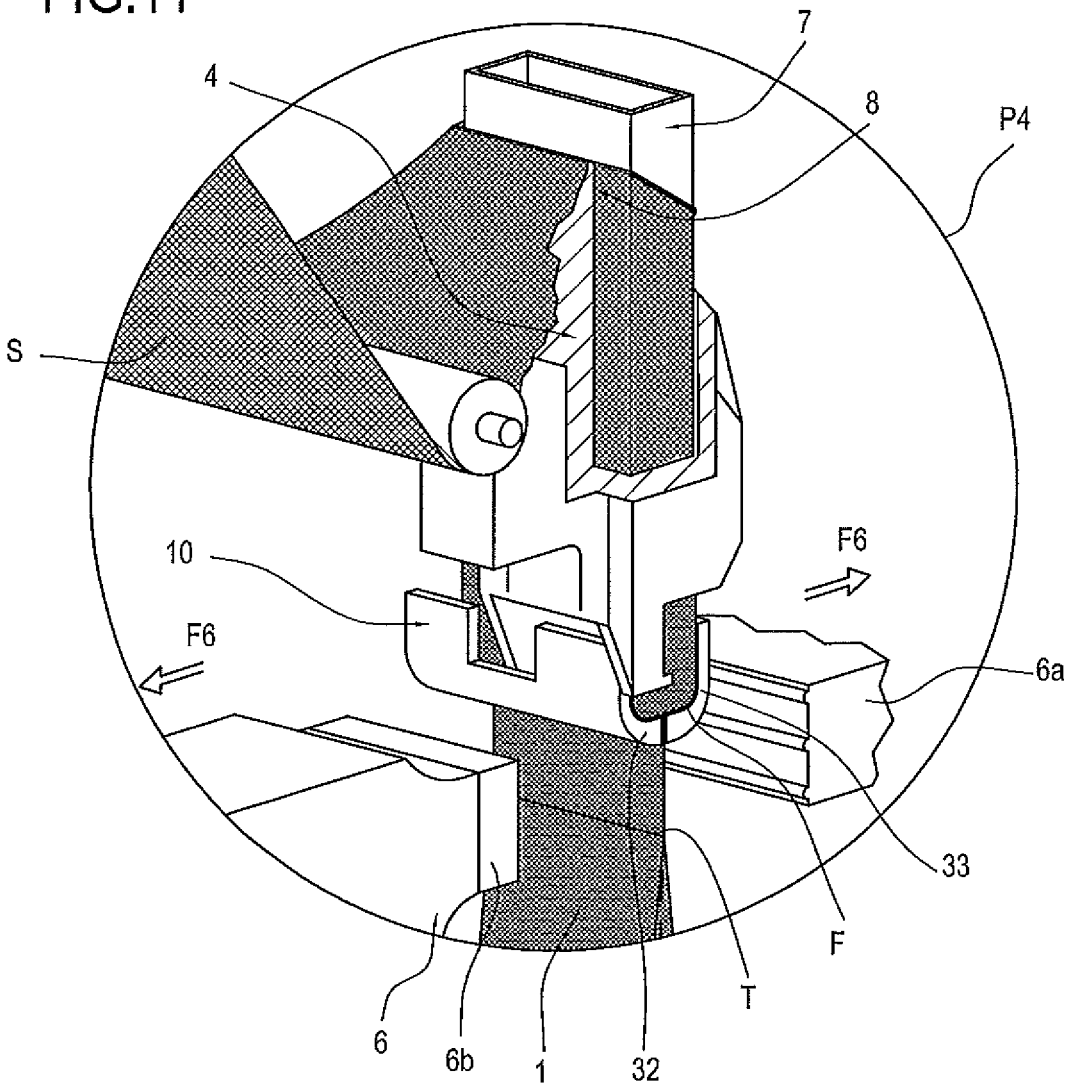
FIG. 11 is a simplified enlarged perspective view referring to FIG. 7, with some parts cut away to better illustrate others, of a detail P4 of the filter paper forming and joining station of FIG. 10 and of first support and control means for the bottom end of a filter bag.

Means 18 for generating lateral folds 19 in the filter bag 1 being formed are also coordinated with the half-cradles 32 and 33 (see FIGS. 7 and 8).

During the downstroke step of the filter bag 1 just filled, the filter bag 1 encounters the generating means 18. The generating means 18 are positioned, along the vertical movement axis Z, in an intermediate zone between the joining station 6 and the separating station 11. In particular, the generating means 18 act on both sides of the filter bag 1 during the downstroke step of the half-cradles 32 and 33, thus obtaining the folds 19 during the downstroke, until the top end/bottom end have been sealed.

Advantageously, the means 18 for generating the folds 19 comprise two bars 43 with an end tapering to a point. One end of each bar 43 is rotatably connected to a movement rod 44. The rod 44 may be moved linearly (see arrows F44 in FIG. 8) in a direction parallel with the arrows F6 and transversal to the vertical movement axis Z between a forward position, in which the bars 43 on both sides are next to the filter bag 1 being formed, and a back position, in which the bars 43 are away from the filter bag 1.

In the forward position, each rod 44 is made to rotate about its own longitudinal axis 44*x* to obtain a respective rotation of the pointed end to an operating position in which it makes contact with the sides of the filter bag 1 being formed. Therefore, the opposing action of the pointed ends of the bars 43 on the filter bag 1 causes the folds 19 to be generated. The pointed ends of the bars 43 are kept in the operating position during the downstroke step of the filter bag 1 being formed.

Returning to the above-mentioned cradles 32 and 33. After they have passed beyond the bars 43, they reach the lowered position and, once the top end T of the filter bag 1 being formed has been formed, they release the bottom end F at the separating station 11.

As already indicated, the handling and control unit comprises second support and control means 12 for the bottom end F of the filter bag 1.

The second support and control means 12 operate in such a way that they are synchronised with the first support and control means 10, for clamping and holding the bottom end F in a predetermined position.

In practice, these second support and control means 12 comprise two vertical walls 38 and 39 for gripping/retaining the filter bag 1 being formed in a position immediately before, that is to say close to, cutting means 13 belonging to the separating station 11 which are positioned downstream of the vertical walls 38 and 39, again with reference to the vertical feed axis Z.

Movement levers 40 and 41 controlled by known drive means (not illustrated) move the vertical walls 38 and 39 (see in particular FIGS. 6 and 9) between:

- a non-operating position, in which the walls 38 and 39 are away from each other (see FIGS. 4 to 7) allowing the downstroke movement of the filter bag 1 pulled downwards by the first support and control means 10, and
- an operating position, in which the walls 38 and 39 are close to each other, for clamping and supporting the bottom end F of the filter bag 1.

In practice, the vertical walls 38 39 adopt the operating position immediately before the half-cradles 32 and 33 release the bottom end F of the filter bag 1 being formed (see FIGS. 2, 3 and 8), in such a way that the filter bag 1 being formed is guided and controlled at all times. The two walls 38 and 39 are suitably "U"-shaped so that they do not interfere, in the operating position or in the non-operating position, with the cutting means 13 during the separating operation, despite the fact that the cutting means 13 have projecting operating zones.

The cutting means 13 comprise two rollers 13*a* and 13*b* equipped with a respective cutter 13*c* and counter-cutter 13*d* which project radially. The rollers 13*a* and 13*b* are shaped with differences in the diameters along their length, so that as they rotate they do not make contact with the bottom end F of the filter bag 1 already formed and containing the charge D of product. The cutter 13*c* and the counter-cutter 13*d* act on the joining zone between the previous filter bag 1 already formed and the next filter bag being formed. Said zone is located close to the walls 38 and 39 which at that moment are still open. Basically, the cutter 13*c* and the counter-cutter 13*d* separate the transversal band ST of the top end T of the filter bag 1 already formed from the final edge L of the bottom end F of the filter bag 1 being formed which is located higher up.

Figure 6:
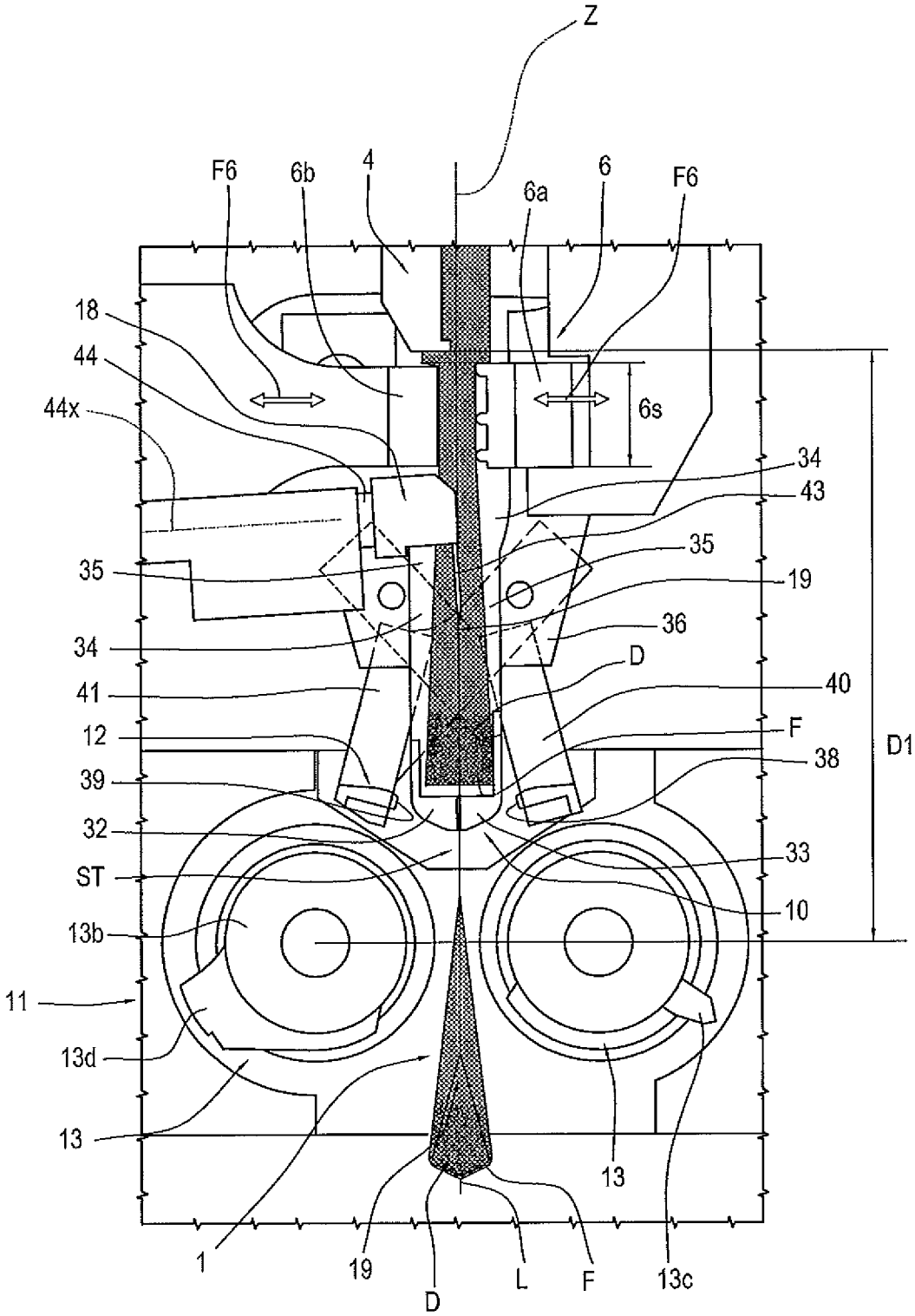
FIG. 6 is a schematic front view of an enlarged detail P2 of FIG. 5, in an operating step immediately after the step illustrated in FIG. 5.

Thanks to this structuring, in particular the first support and control means 10 and the second support and control means 12, the operating zone for basic production of the filter bag 1 is extremely compact. FIG. 6 shows how the distance D1 between the lower end of the forming and joining station 4 (where the charge D of product is deposited) and the station 11 for separating the filter bag 1 formed is approximately equal to the total length of two filter bags 1 which are positioned one after the other along the vertical feed axis Z: however, the distance D1 is less than three filter bags 1 positioned one after another.

The handling and control unit advantageously comprises the third support and control means 14 which act on the filter bag 1 already formed.

For as long as the filter bag 1 already formed is joined to the next filter bag 1 being formed, the third support and control means 14 contribute, synchronised with the first support and control means 10, to pulling downwards the filter bag 1 already formed (and therefore the entire continuous tube of filter paper). Following a cutting step, after the filter bag 1 already formed has been separated from the next filter bag 1 being formed, the third support and control means 14 are independent of the first support and control means 10 and accelerate compared with the latter to bring the filter bag 1 already formed to an application station 15 designed to apply additional elements such as string 16, a tag 17 and an outer envelope 55 to the filter bag 1.

Basically, before, during and after the cutting step, the filter bag 1 already formed is constantly retained and controlled in position by the third support and control means 14.

The third support and control means 14 are positioned along the vertical feed axis Z downstream of the separating station 11, and are designed for picking up and moving the filter bag 1 already formed from the separating station 11 to the application station 15.

As described in more detail below, the application station 15 is located below the third support and control means 14, again with reference to the vertical feed axis Z.

The third support and control means 14 comprise a gripping gripper 24 designed to receive the filter bag 1 already formed and to clamp its outer edges. Basically (see in particular FIGS. 2 to 5), the gripping gripper 24 comprises a substantially quadrangular double frame hinged to a movement head 45 which is connected to respective drive means 46. The drive means 46 allow gripper 24 opening (FIG. 2, arrows F24) and closing (FIGS. 3 to 5), whilst a lever 47 allows the head 45 with the gripper 24 to be inserted in the separating station 11 then to move down as far as the application station 15 (arrows F47 in FIG. 5).

Figure 2:
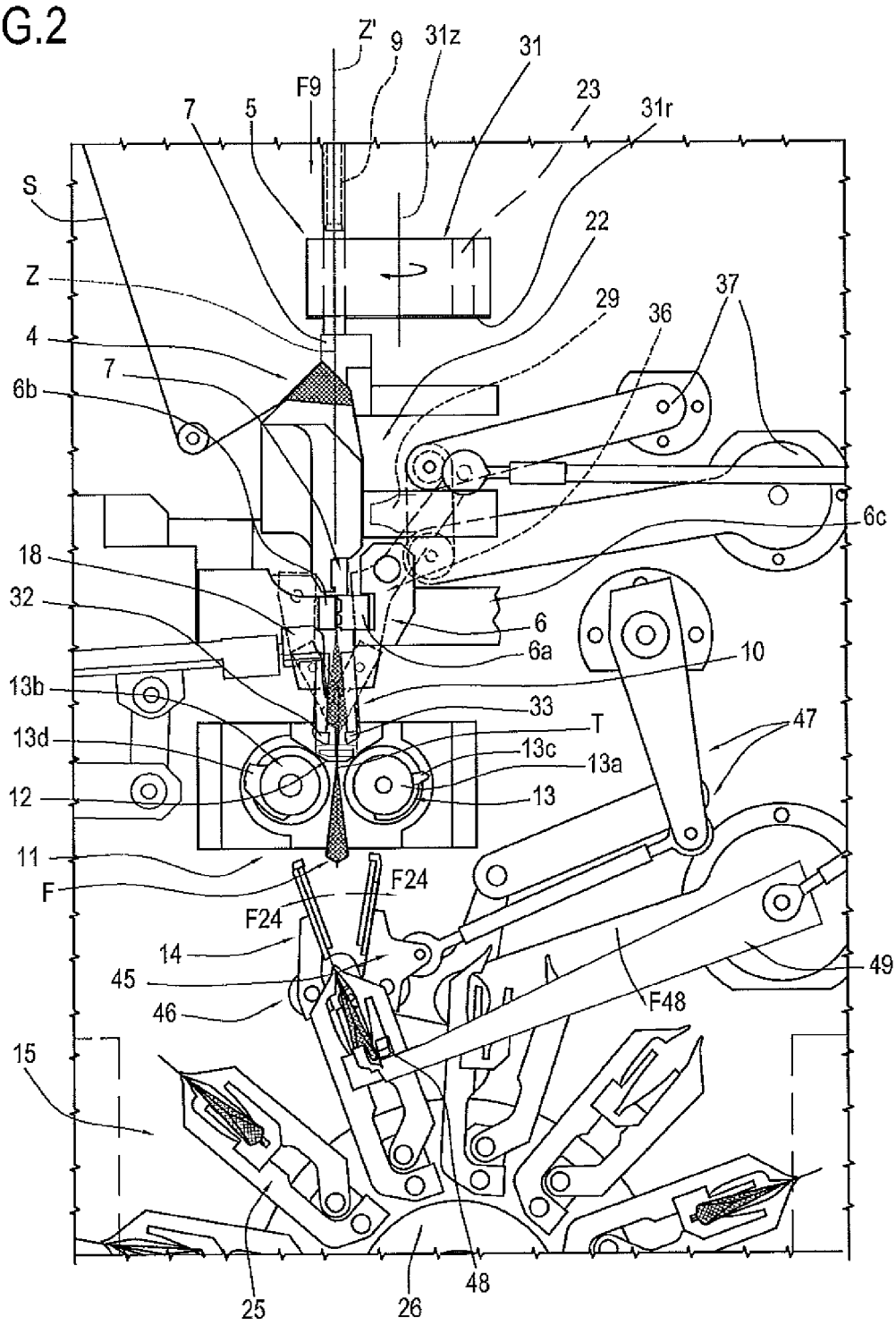
FIGS. 2 to 5 are all schematic front views of a detail P1 of the machine of FIG. 1, in particular a zone for forming, filling, closing and separating the filter bag, in a sequence of operating steps.
Figure 3:
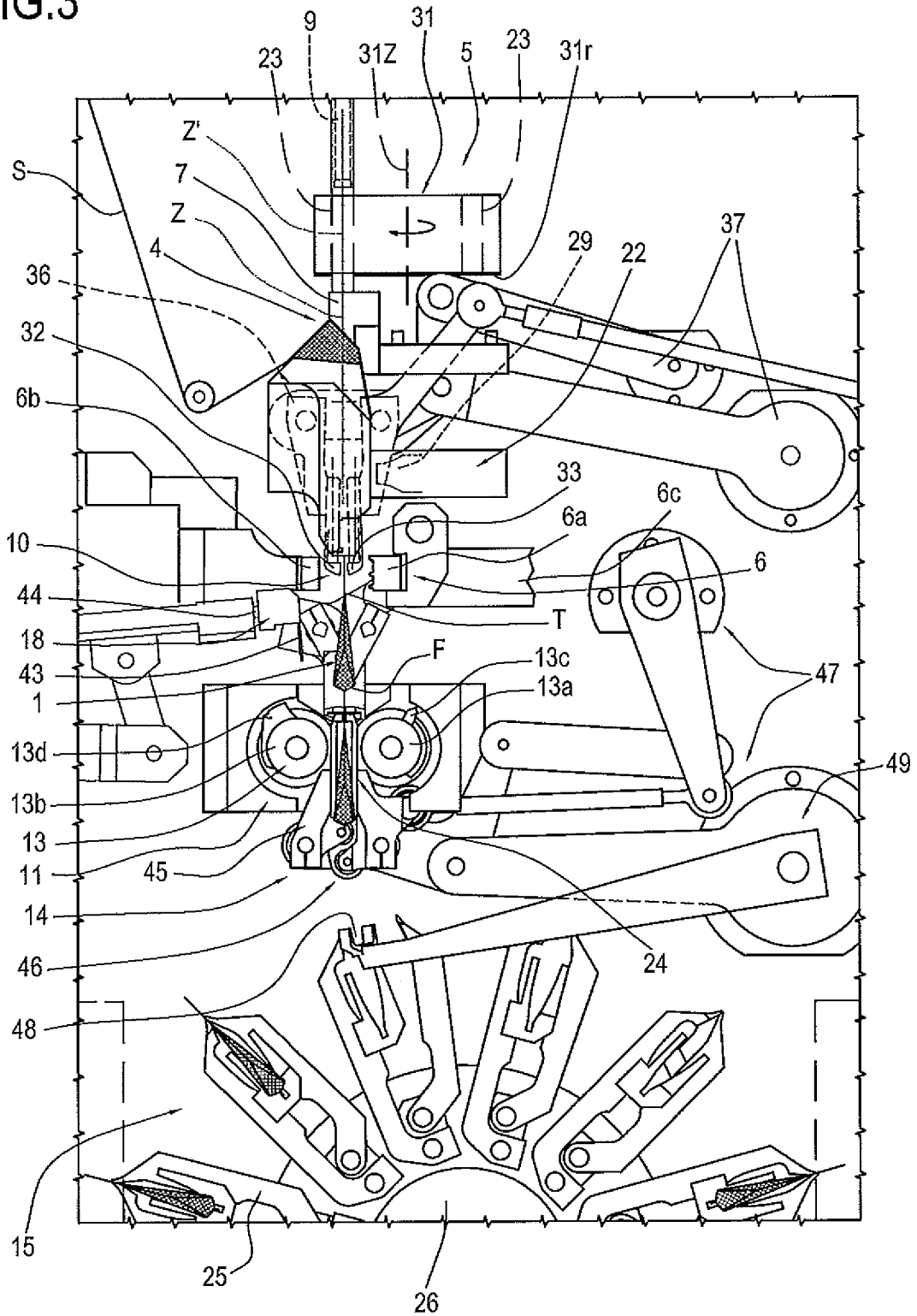
Figure 4:
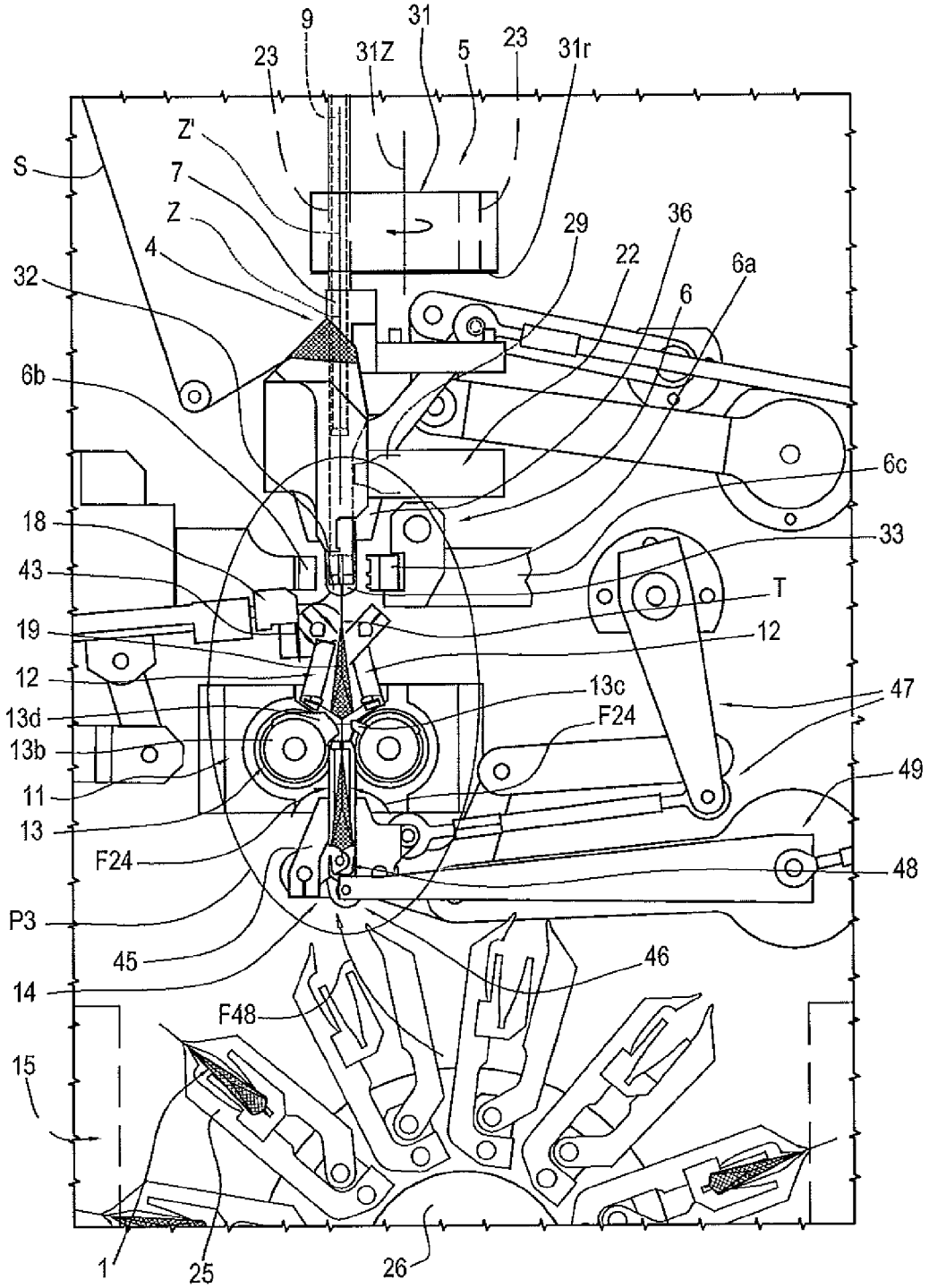

The open gripper 24 moves into the separating station 11 between the roller 13*a* and the roller 13*b*, then closes on the filter bag 1 already formed (see FIGS. 2 and 3).

The lever 47 then starts to lower the gripper 24 which retains the filter bag 1 already formed, initially synchronised with the first support and control means 10 whilst the cutter 13*c* and the counter cutter 13*d* use a cutting action to separate the filter bag 1 already formed from the filter bag 1 being formed, without intersecting with the gripper 24. After the cutting, the lever 27 lowers the gripper 24 in such a way that it is independent of the first support and control means 10.

After picking up the filter bag 1 already formed, the gripper 24 performs a downstroke to deposit said filter bag 1 in a radial gripper 25 which is part of a plurality of grippers belonging to a rotary carousel 26 of the application station 15.

With reference to FIGS. 2 to 5, the gripper 24 may be assisted (during pickup and until the release of the filter bag 1) by a supporting cradle 48 for supporting the bottom end F of the filter bag 1 and if necessary feeding the string 16. The cradle 48 can move independently of the gripper 24 thanks to dedicated movement means 49, but is synchronised with the gripper 24 movement head 45, the respective drive means 46 and the lever 47. The cradle 48 can move with a synchronised delayed action relative to the gripper 24, that is to say, it is positioned at the bottom end F of the filter bag 1 when the gripper 24 is already closed (see arrows F48 and FIGS. 2 to 5). Therefore, the combination of the gripper 24 and the cradle 48 allows a movement of the filter bag 1 to be obtained which is extremely secure and without risks of "abandoning" it, even with extremely high operating speeds.

Figure 5:
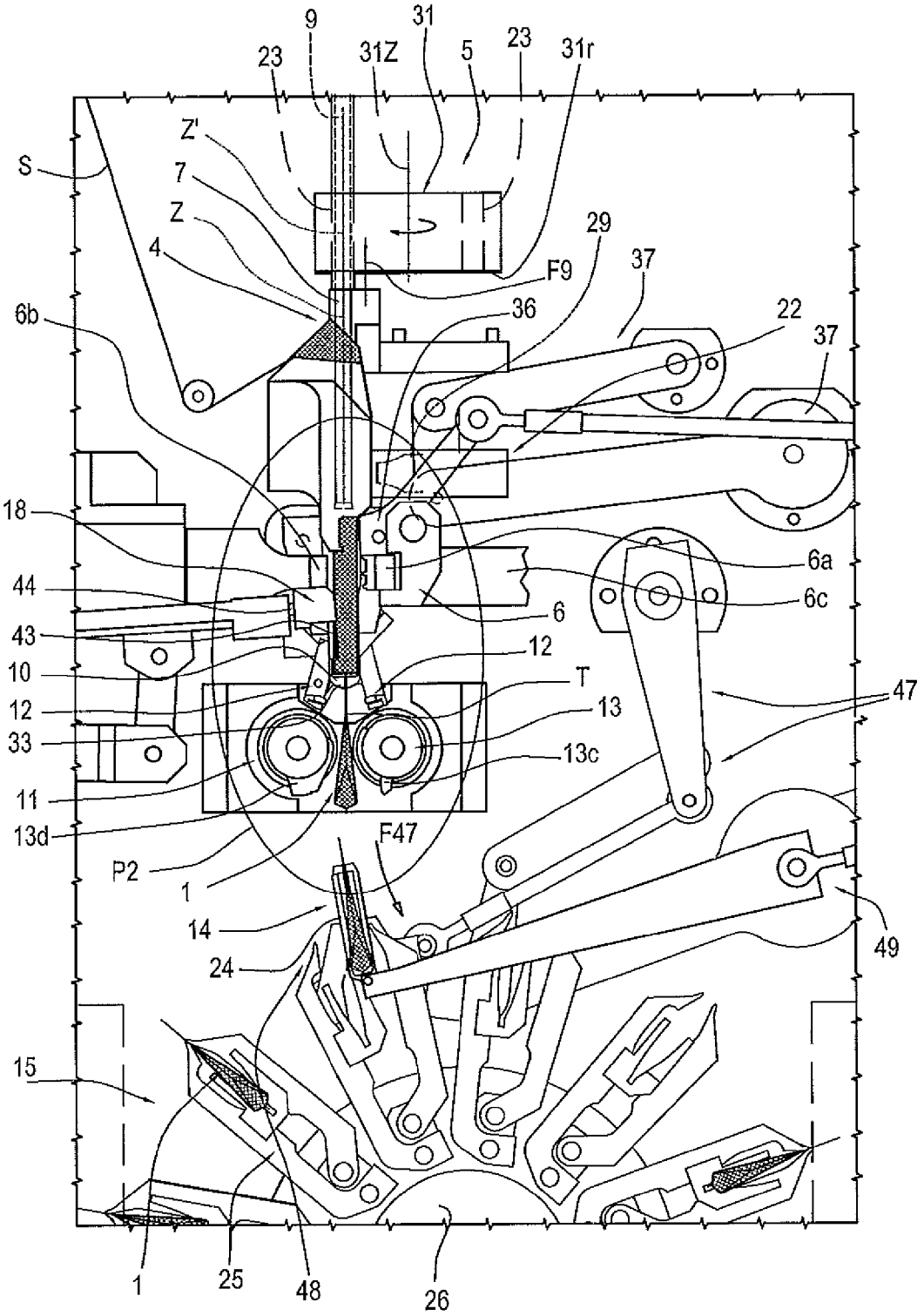

The filter bag 1 is placed on the radial gripper 25 where it is clamped while the gripper 24 and the cradle 48 move away (FIGS. 2 and 5).

At this point, again with a stepping motion, the rotating carousel 26 reaches operating zones along a circular path (for example anti-clockwise in FIG. 1).

In the case illustrated, by way of example only, the following are present: a first station 50 for applying the string 16 to the filter bag 1; a second station 52 for applying the tag 17 to both the string 16 and to the filter bag 1, and a third station 54 for applying an outer envelope 55 to cover the filter bag 1.

After a rotation of approximately 270° by the carousel 26, the string 16, the tag 17 and the outer envelope 55 have been added to the filter bag 1 to make an individual pack CS which is released into a stacking and insertion station 56 for stacking and inserting a predetermined number of packs CS in a respective box 57.

The first station 50, the second station 52, the third station 54 and the stacking and insertion station 56 are not described in detail, since they are of the known type and are not strictly part of this invention.

The machine 2 described allows the implementation of a method for making filter bags 1 comprising the following steps:

- a step of vertically forming a continuous tube of filter paper from a continuous web S of filter paper, the continuous tube of filter paper being sealed along a vertical feed axis Z;
- a step of sealing an open end of the continuous tube of filter paper to form a top end T of a filter bag 1 being formed and a bottom end F of the next filter bag 1;
- a step of forcibly inserting, by means of the thrust from a pusher element 9, a charge D of infusion product onto the bottom end F of the filter bag 1 being formed along the vertical feed axis Z and simultaneously the step of a controlled downstroke of the bottom end F of the filter bag 1 being formed along the vertical feed axis Z with the aid of a handling and control unit advantageously comprising first support and control means 10 acting on the bottom end F, advantageously for a stroke equal to the length of one filter bag 1.

The method advantageously also comprising, simultaneously with the downstroke step, a step of generating lateral folds 19 in the filter bag 1 being formed.

After the step of sealing the open end of the continuous tube of filter paper, there is a step of passing the bottom end F of a filter bag 1 already formed from the first support and control means 10 to second support and control means 12 of the handling and control unit, for a controlled stand by step, and simultaneous return upstroke of the first support and control means 10 for receiving the next filter bag 1 being formed.

Before a step of moving away the second support and control means 12, there is a step of gripping and supporting the filter bag 1 already formed by means of third support and control means 14 of the handling and control unit.

The step of moving away the second support and control means 12 allows a downstroke step of the filter bag 1 being formed along the vertical axis Z, thanks to the first support and control means 10 which pull the filter bag 1 being formed downwards and thanks to the third support and control means 14 which pull the filter bag 1 already formed downwards in such a way that they are synchronised with the first support and control means 10. During the downstroke step of the filter bag 1 already formed towards a separating station 11, a step of separating the filter bag 1 already formed from the next filter bag 1 is performed.

After the separating step there is a step of conveying the filter bag 1 already formed from the separating station 11 to an application station 15 designed to apply one or more additional elements, such as the string 16, a tag 17 and an outer envelope 55.

A machine and a method of the type illustrated achieve the preset aims thanks to a precise, reliable and compact handling and control unit, which allows a precise, controlled, compact and therefore fast vertical filling system to be used. It should be noticed how a handling and control unit of the type illustrated allows the filter bag to be precisely controlled and guided during all steps, so that it becomes possible to fill the product in a very precise way. Moreover, the handling and control unit is compact, to the extent that its allows the filling station to be close to the joining station, so that the pusher element performs a relatively short stroke, which is advantageous in terms of speed and productivity.

The architecture of the operating stations, located immediately after the filling zone, allows, in reduced vertical spaces, the creation of a filter bag 1 in a distance equal to two filter bags 1 placed one after the other. This is with high production speeds, even with intermittent motion, and obtaining final pack quality standards that are extremely high thanks to continuous control of the movements and the positions of the filter bag during all steps. Such reduced dimensions allow the insertion, in a single machine, even of application stations and those designed for filter bag final packaging.

The invention described above is susceptible of industrial application and may be modified and adapted in several ways without thereby departing from the scope of the inventive concept. Moreover, all the details of the invention may be substituted by technically equivalent elements.

The invention claimed is:

1. A machine for making filter bags (1) with infusion products comprising:

a feed station (3) for feeding a continuous web (S) of filter material;

a station (4) for forming and joining the continuous web (S) into a closed, tubular shape which is fed along a vertical feed axis (Z);

a filling station (5) for filling the infusion product, the filling station being positioned above the forming and joining station (4);

a sealing station for sealing an open portion of the continuous web (S) in the tubular shape, the sealing station (6) comprising heads (6*a*, 6*b*) effective to form a top end (T) of a filter bag (1) being formed and a bottom end (F) of the next filter bag (1); the sealing station (6) being positioned downstream of the forming and joining station (4) relative to the vertical feed axis (Z);

a station (11) for separating a filter bag (1) already formed from the next filter bag (1) which is being formed, the separating station being positioned along the vertical feed axis (Z), downstream of the sealing station (6);

characterised in that it comprises:

a handling and control unit with first support and control means (10) which are effective to pull downwardly along the vertical feed axis (Z) the bottom end (F) of the filter bag (1) being formed, from a first position in which the first support and control means (10) are located adjacent the heads (6*a*, 6*b*), to a second, lower, position in which the first support and control means (10) are located in a lower position relative to the heads (6*a*, 6*b*), the first support and control means (10) being able to move in such a way that they are synchronised with the sealing station (6);

the filling station (5) comprising an element (9) for pushing a charge (D) of product, being able to move in both directions along the vertical feed axis (Z), and acting on the charge (D) for depositing during acceleration the charge (D) on the bottom end (F) of the filter bag (1) being formed.

2. The machine according to claim 1, wherein the handling and control unit also comprises second support and control means (12) for clamping in position the bottom end (F) of the filter bag (1) being formed while the top end (T) of the filter bag (1) is formed, the second support and control means acting in such a way that they are synchronised with the first support means (10), for holding the bottom end (F) in a predetermined position after the bottom end (F) has been released by the first support means (10).

3. The machine according to claim 1, comprising a tubular core (7), in which the pusher element (9) is designed to slide, the tubular core being positioned along the vertical feed axis (Z) in such a way as to form an extension of the filling station (5); the tubular core (7) being inserted in a cavity (8) made in the forming and joining station (4), thus, in conjunction with the forming and joining station (4), forming a shaping zone which forces the continuous web (S) around the core (7) at least until it is close to the sealing station (6) which is positioned below the forming and joining station (4).

4. The machine according to claim 1, comprising third support and control means (14) which are positioned along the vertical feed axis (Z), and designed for picking up and moving the filter bag (1) already formed from the separating station (11) to an application station (15) designed to apply additional elements (16, 17, 55) to the filter bag (1), the application station being located below the third support and control means (14), with reference to the vertical feed axis (Z).

5. The machine according to claim 1, comprising generating means (18) for generating lateral folds (19) in the filter bag (1) being formed, acting on both sides of the filter bag (1) during a downstroke of the filter bag (1) being formed which is controlled by the first support and control means (10), thus obtaining the lateral folds (19) during a downstroke.

6. The machine according to claim 1, wherein the forming and joining station (4) comprises a pair of wings (20, 21), positioned in offset vertical planes, for superposing longitudinal free edges (S1, S2) of the continuous web (S) of filter material, in a direction parallel with the vertical feed axis (Z).

7. The machine according to claim 6, wherein the forming and joining station (4) comprises joining means (22) for joining the superposed free edges (S1, S2), the joining means being positioned transversally relative to the vertical feed axis (Z), and opposite the tubular core (7) which acts as an opposing surface for the joining means (22).

8. The machine according to claim 1, wherein the filling station (5) comprises a set of holders (23) for the product, forming individual charges (D) to be filled; the filling station (5) being designed to position one holder (23) at a time at an axis (Z') which is coaxial with the vertical feed axis (Z), in such a way that it can engage with the pusher element (9), which passes through the holder (23), for accelerating the depositing of the charge (D) on the bottom end (F) of the filter bag (1) being formed.

9. The machine according to claim 4, wherein the third support and control means (14) comprise at least one gripping gripper (24) designed to receive a filter bag (1) already formed and to clamp its outer edges; the third support and control means (14) being synchronised with the separating station (11) for picking up the filter bag (1) and depositing it, by means of a vertical downstroke, in a radial gripper (25) which is part of a rotary carousel (26) forming the station (15) for application of additional elements (16, 17, 55) to the filter bag (1).

10. A method for making filter bags (1) comprising the following steps:

a step of vertically forming a continuous tube of filter material from a continuous web (S) of filter material, the continuous tube of filter material being sealed along a vertical feed axis (Z);

a step of sealing, via heads (6*a*, 6*b*), an open portion of the continuous tube of filter material to form a top end (T) of a filter bag (1) being formed and a bottom end (F) of the next filter bag (1);

a step of forcibly inserting, by means of a thrust from a pusher element (9), a charge (D) of infusion product onto the bottom end (F) of a filter bag (1) being formed along the vertical feed axis (Z) and a step of a controlled downstroke of the bottom end (F) of the filter bag (1) being formed along the vertical feed axis (Z) with the aid of first support and control means (10) acting on the bottom end (F), the first support and control means (10) pulling for a downward stroke along the vertical feed axis (Z) the bottom end (F) of the filter bag (1) being formed, from a first position in which the first support and control means (10) are located adjacent the heads (6*a*, 6*b*), to a second, lower, position in which the first support and control means (10) are located in a lower position relative to the heads (6*a*, 6*b*);

after the step of sealing the open portion of the continuous tube of filter material, a step of passing the bottom end (F) of a filter bag (1) already formed from the first support and control means (10) to second support and control means (12) for a controlled stand-by step and simultaneous return upstroke of the first support and control means (10) for receiving the next filter bag (1) being formed;

a step of separating a filter bag (1) already formed from the next filter bag (1).

11. The method according to claim 10, comprising simultaneously with the downstroke step, a step of generating lateral folds (19) in the filter bag (1) being formed.

12. The method according to claim 10, comprising, before a step of moving away the second support and control means (12), a step of gripping and supporting the filter bag (1) already formed by means of third support and control means (14).

13. The method according to claim 12, comprising, after the separating step, a step in which the filter bag (1) already formed is conveyed by the third support and control means (14) from a separating station (11) to an application station (15) designed to apply one or more additional elements (16, 17, 55).

* * * * *